United States Patent [19]

Grable

[11] 4,220,938

[45] Sep. 2, 1980

[54] THERMOSTATIC ELECTRICAL SWITCH

[75] Inventor: Jack W. Grable, Dayton, Ohio

[73] Assignee: Emerson Electric Co., St. Louis, Mo.

[21] Appl. No.: 11,326

[22] Filed: Feb. 12, 1979

Related U.S. Application Data

[63] Continuation-in-part of Ser. No. 882,877, Mar. 2, 1978, Pat. No. 4,157,525.

[51] Int. Cl.[2] ..... H01H 61/00

[52] U.S. Cl. ..... 337/89; 337/94

[58] Field of Search ..... 337/89, 94, 112, 113, 337/343, 347, 365, 368; 29/622, 623

[56] References Cited

U.S. PATENT DOCUMENTS

| | | | |
|---|---|---|---|
| 2,487,684 | 11/1949 | Smith | 337/365 |
| 2,619,564 | 11/1952 | Raleigh | 337/113 X |
| 2,720,416 | 10/1955 | Raleigh | 337/89 X |
| 3,171,925 | 3/1965 | Malone et al. | 337/89 X |
| 3,194,924 | 7/1965 | Moksu et al. | 337/89 |
| 3,213,246 | 10/1965 | Duval | 337/112 |
| 3,430,177 | 2/1969 | Audette | 337/89 X |
| 3,453,577 | 7/1969 | D'Entremont | 337/112 X |
| 3,562,690 | 2/1971 | Vezza | 337/89 |
| 3,622,930 | 11/1971 | D'Entremont | 337/89 X |
| 4,047,141 | 9/1977 | Holden | 337/89 |

*Primary Examiner*—George Harris

*Attorney, Agent, or Firm*—Biebel, French & Nauman

[57] ABSTRACT

A thermostatic electrical switch for providing an electrically conductive path when the temperature of the switch is below a threshold temperature and for opening the path when the temperature of the switch is above the threshold temperature, includes a bimetal thermostatic element which is riveted to a support post. The post is welded to a base plate which forms a portion of the switch casing. An indentation is formed in the casing such that a portion of the mounting for an electrically conductive terminal is urged downwardly, thus positioning the terminal for proper switch operation.

11 Claims, 15 Drawing Figures

THERMOSTATIC ELECTRICAL SWITCH

REFERENCE TO RELATED APPLICATIONS

This application is a continuation-in-part of U.S. Patent Application Ser. No. 882,877, filed Mar. 2, 1978 now U.S Pat. No. 4,157,525.

BACKGROUND OF THE INVENTION

The present invention relates to heat sensitive electrical switching devices. More particularly, the present invention relates to snap action thermostatic electrical switches of the type which are small enough to be incorporated in an electrical device to protect the device from overheating and also to a method of making such switches.

It is desirable to protect electrical devices, such as motors, generators, and transformers, from the effects of overheating. While power supply line circuit breakers provide protection from excessive currents for such electrical devices, circuit breakers do not protect against overheating which may occur during continuous operation of a deivce at a current level which is not excessive. To provide adequate thermal protection for an electrical device, it is necessary that a thermally responsive protective switching arrangement be placed within the device to monitor the temperature of the device. In order for a thermostatic switch to be positionable within an electrical device, such as in the windings of an electric motor, it is necessary that the thermostatic switch be relatively small in size, but in fabricating such a miniaturized thermostatic switch, accurate positioning of the switch elements is difficult to achieve.

In several switch constructions, such as shown in U.S. Pat. No. 3,213,246, issued Oct. 19, 1965, to Duval, and U.S. Pat. No. 3,453,577, issued July 1, 1969, to D'Entremont, a switch casing is formed from a single piece of metal which is drawn into the desired elongated casing shape. Assembly of the switch elements within the switch casing then must necessarily be accomplished in a series of operations during which it is not possible to see the orientation of the switching elements. Such a "blind" assembly procedure is time consuming and can result in misalignment of switch elements.

Other switch constructions are known in which the casing for the thermostatic switch is formed of two separate pieces of material, U.S. Pat. No. 3,430,177, issued Feb. 25, 1969, to Audette discloses a thermostatic switch having a two-piece casing. The casing components are, however, joined either with a thermosetting adhesive or by crimping. The casing components in the Audette switch are connected electrically to opposite sides of the switch and therefore must be electrically isolated from each other by an insulating gasket or similar non-conductive element. After the switch is assembled, one of the casing components is dented, thereby adjusting the position of a switch contact mounted directly on the casing component with respect to a bimetal switch blade.

U.S. Pat. No. 3,622,930, issued Nov. 23, 1971, to D'Entremont, also discloses a motor protector switch having a two-part casing, which parts are jointed in a crimp operation. It will be appreciated that such casing arrangements may not provide an adequately sealed casing and, also, when switch components are mounted on both portions of the casing, assembly of the casing results in a blind orientation of the switch components.

Additionally,, if components are mounted on both portions of the casing, the required insulating material between the casing portions may adversely affect the casing seal.

A number of techniques have been used in switches of this general type to mount a bimetal blade on a portion of the switch casing. Most commonly, as shown in U.S. Pat. Nos. 3,453,577, issued July 1, 1969, to D'Entremont; 3,194,924, issued July 13, 1965, to Moksu et al; 2,487,684, issued Nov. 8, 1949, to Smith; 3,622,930, issued Nov. 23, 1971, to D'Entremont; 3,213,246, issued Oct. 19, 1965, to Duval; and 3,430,177, issued Feb. 25, 1969, to Audette; the bimetal switch blade is welded to a portion of the switch casing or an intermediate mounting structure. Although such a mounting arrangement provides good electrical interconnection between the bimetal blade and the switch casing, it has been found that elevating the end of the blade to the temperatures required for welding may deleteriously affect the thermal snap action characteristic of the blade.

Another approach to mounting the blade is shown in U.S. Pat. No. 3,562,690, issued Feb. 9, 1971, to Vezza. In the Vezza switch, the bimetal switch blade is mounted by means of a screw which extends through a hole in the blade and is threaded into a switch supporting structure. In U.S. Pat. No. 2,720,416, issued Oct. 11, 1955, to Raleigh, the bimetal blade is riveted to a blade supporting post. The post has a threaded portion extending through an opening in the switch casing, with a nut engaging the threaded portion and securing it to the casing. U.S. Pat. No. 2,619,564, issued Nov. 25, 1952, to Raleigh, is somewhat similar in construction, but the blade supporting post is received into an opening in the switch casing and brazed to the casing. The latter three patents all require that an accurately located hole be formed in the switch casing or mounting structure for receiving a blade supporting post or screw. Such an arrangement requires additional manufacturing steps and, therefore, adds substantially to the cost of the final switch.

In relatively small thermostatic switches of the type to which the present invention is directed, the component elements, whether assembled in a blind operation inside a closed case or whether assembled prior to forming the case, present a calibration problem. In particular, it is important that the elements be positioned such that good electrical connection exists between the stationary contact and the contact mounted on the snap element bimetal blade. In U.S. Pat. No. 3,430,177, issued Feb. 25, 1969, to Audette, the position of the stationary contact mounted on a portion of the casing is adjusted by denting or distorting the casing after complete assembly of the switch. Such an adjustment procedure may not be readily applicable to a switch having the stationary contact mounted on insulating mounting structure within the casing.

It is seen, therefore, that there is a need for a simple, easily assembled thermostatic electrical switch which is small in size and which provides reliable thermal switch actuation.

SUMMARY OF THE INVENTION

A thermostatic electrical switch construction and method of switch assembly are provided for an electrical switch which forms an electrically conductive path in a first switching state when the temperature of the switch is below a threshold temperature and which opens the path in a second switching state when the temperature of the switch is above the threshold temperature. The switch includes a conductive base plate and a bimetal thermostatic snap element which is generally concave upwardly in a first switching position when its temperature is less than the threshold temperature and which snaps to a second straightened switching position when its temperature is above the threshold temperature.

The snap element defines a first rivet receiving opening in a first end thereof. A rivet means extends through the rivet receiving opening in the snap element and is riveted thereto. The rivet means is welded to the base plate and mounts the snap element on the top of the base plate thereby connecting electrically the base plate and the snap element.

An electrical snap contact is mounted on the upper surface of the snap element, adjacent a second end of the snap element opposite the first end, and is electrically connected to the snap element. A conductive cap covers the snap element and is welded to the base plate around a portion of the periphery of the cap. The cap and the base plate form a casing which defines a casing cavity within which is positioned the snap element. The casing further defines an opening communicating with the cavity. An electrically conductive terminal, having a connector at a first end and a terminal contact at a second end thereof, is mounted by a mounting means in the opening in the casing such that the terminal extends through the opening. The orientation of the terminal is such that the terminal contact is in contact with the snap contact when the temperature of the snap element is less than the threshold temperature. An electrical path is thereby provided from the casing to the conductive terminal via the snap element and the snap contact until the temperature of the switch exceeds the threshold temperature, at which time the snap element snaps to a straightened position, breaking the conductive path between the terminal contact and the snap contact.

A second electrical connector is provided on the casing in electrical contact with the casing. The second connector may advantageously be formed as a part of the conductive base plate.

The mounting means comprises a non-conductive mounting which is sized to fit within the cavity in the casing and defines a terminal opening through which the terminal extends. The mounting means may further comprise a layer of epoxy material surrounding the terminal, adjacent the opening in the casing, which material provides a seal across the opening. The non-conductive mounting includes a terminal backing portion extending parallel to and above the electrically conductive terminal in the casing cavity. The conductive cap defines an indentation in the upper portion thereof, with the indentation contacting the terminal backing portion. The electrically conductive terminal is therefore urged downward by the backing portion such that the terminal contact is positioned for electrical contact with the snap contact.

Accordingly, it is an object of the present invention to provide a thermostatic switch and a method of assembly of such a switch in which assembly of switch elements is facilitated and proper alignment and calibration of elements insured; to provide such a switch and method of assembly in which the thermal characteristics of a bimetal element are unaffected during switch assembly; and to provide such a switch and method of assembly for a mechanically simple and reliable switch.

Other objects and advantages of the invention will be apparent from the following description, the accompanying drawings and the appended claims.

Figure 3:
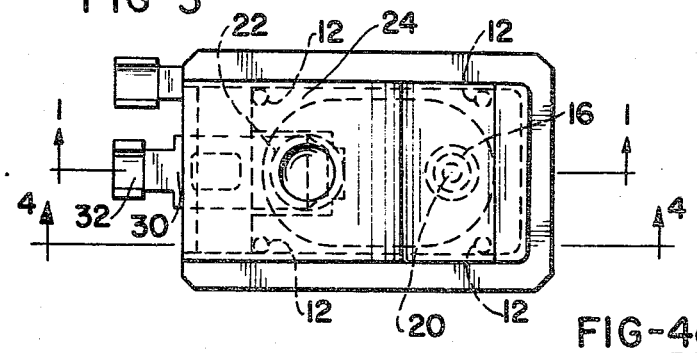
FIG. 3 is a plan view of the switch of FIG. 1.

FIGS. *4a–4f* are sectional views taken generally along line 4—4 in FIG. 3, showing a method of assembly of the switch of the present invention; and FIGS. *5a–5f* are sectional views taken generally along line 4—4 in FIG. 3, showing an alternative method of assembly of the switch of the present invention.

DETAILED DESCRIPTION OF THE PREFERRED EMBODIMENTS

Figure 1:
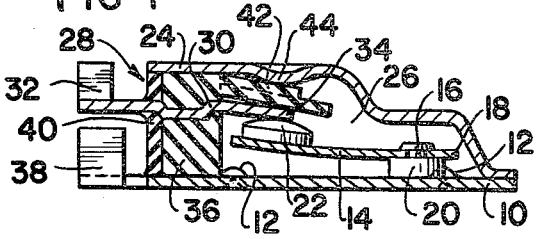
FIG. 1 is a sectional view of the thermostatic electrical switch of the present invention, taken generally along line 1—1 in FIG. 3.
Figure 2:
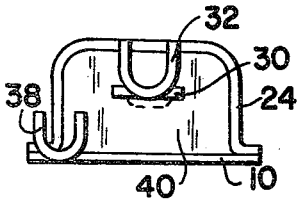
FIG. 2 is a side view of the present invention, as seen looking generally left to right in FIG. 1.

Reference is now made to FIGS. 1–3 in which the thermostatic electrical switch of the present invention is shown. This switch provides an electrically conductive path when the temperature of the switch is below a threshold temperature and opens this path when the temperature of the switch is above the threshold temperature. A base plate 10, formed of a conductive material, such as cold rolled steel, has positioning bosses 12 formed on its top surface. A bimetal snap element 14 is generally concave upwardly when its temperature is less than the threshold temperature. The snap element 14 snaps to a straightened position when its temperature is above the threshold temperature. Bimetal snap elements are known in the art which provide rapid snap action at a relatively precise temperature threshold point. Snap element 14 defines a rivet receiving opening 16 in a first end 18 thereof. A rivet means, including electrically conductive support post 20, extends through rivet receiving opening 16 and is riveted thereto. The rivet means mounts the snap element 14 on the top of the base plate 10 and connects the base plate 10 and the snap element 14 electrically. The support post 20 is welded to the top of the base plate.

An electrical snap contact 22 is mounted on the upper surface of the snap element 14 adjacent a second end of the snap element and is electrically connected to the snap element 14. A conductive cap 24 covers the snap element 14 and is welded to the base plate 10 on three sides around a portion of the periphery of the cap 24, as seen in FIG. 3. The cap 24 and base plate 10 form a casing which defines a casing cavity 26 in which the snap element 14 is positioned. The casing further defines an opening 28 which communicates with cavity 26.

An electrically conductive terminal 30 has a connector 32 at a first end and a terminal contact 34 at a second end thereof. Terminal 30 may advantageously be formed of yellow brass with the bottom portion thereof forming the terminal contact 34 comprising a layer of silver which is deposited on the second end of the terminal.

A mounting means, including non-conductive mounting 36, is provided in the opening 28 for mounting terminal 30 such that the terminal 30 extends through the opening 28. The terminal contact 34 is in contact with snap contact 22 when the temperature of the snap element 14 is less than the threshold temperature. An electrical path is thereby provided from the casing to the conductive terminal 30 via the snap element 14 and the snap contact 22 until the temperature of the switch exceeds the threshold temperature, at which time the snap element 14 snaps to a straightened position, breaking the conductive path between the terminal contact 34 and the snap contact 22.

A second electrical connector 38 is provided on the casing for electrical connection thereto. Although the connector 38 is shown as integrally formed as a part of the base plate 10, it should be understood that the connector 38 formed need not be integrally formed with the base plate 10 and, further, that it may be positioned on the opposite end of the casing.

The mounting means additionally comprises a layer of epoxy material 40 surrounding the terminal 30 adjacent opening 28 in the casing and providing a seal across the opening. The non-conductive mounting 36 is sized to fit within the cavity 26 and defines a terminal opening through which the terminal 30 extends. The non-conductive mounting 36 further comprises a terminal backing portion 42 extending parallel to and above the electrically conductive terminal 30 in the casing cavity 26. The conductive cap 24 defines an indentation 44 in the upper portion thereof. Indentation 44 contacts terminal backing portion 42 such that the electrically conductive terminal 30 is urged downward by the backing portion 42, positioning terminal contact 34 for electrical contact with the snap contact 22.

Positioning bosses 12 on the upper surface of the base plate 10, abut the mounting 36 and provide proper positioning of the terminal 30 and the mounting 36 with respect to the casing and the snap element 14. As seen in FIG. 1, the mounting 36 will be held securely between the positioning bosses 12 and the epoxy material 40.

It should be understood that, although the thermostatic electrical switch illustrated in the drawings provides an electrically conductive path when the temperature of the switch is below the threshold temperature, the present invention also encompasses a thermostatic switch which is open below a threshold temperature and which provides a closed electrically conductive path only when the temperature of the switch exceeds the threshold temperature. Whether the switch is open or closed at temperatures below the threshold temperature is determined by the snap action of the bimetal thermostatic snap element.

Figure 4A:
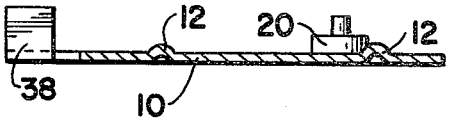
Figure 4D:
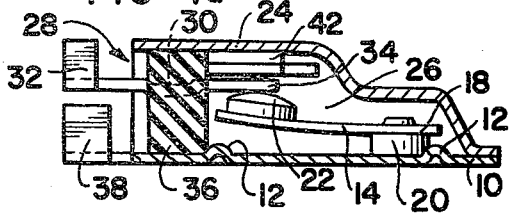
Figure 4B:
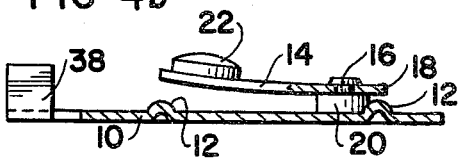

Reference is now made to FIGS. 4*a*–4*f* which illustrate one method of assembly of the thermostatic switch. As shown in FIG. 4*a*, the base plate 10 is formed into the desired shape, typically by a stamping operation using a punch press. The support post 20 is then welded to the top of the base plate such that a good electrical contact between the plate 10 and the post 20 is formed. As shown in FIG. 4*b*, the bimetal snap element 14 is riveted to the top of post 20. The post 20 is sized to fit through the rivet receiving opening 16. The riveting operation will therefore provide firm attachment of one end of the snap element 14 to the post 20 and, additionally, provide the necessary electrical connection between the snap element 14 and the base plate 10.

Figure 4E:
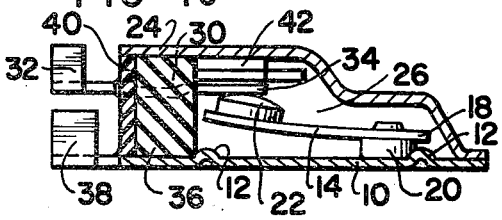
Figure 4C:
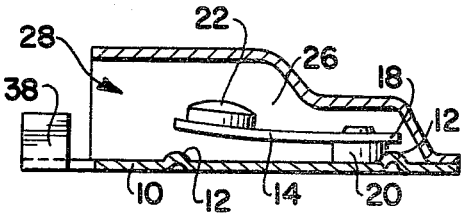

Conductive cap 24 is stamped from a cold rolled steel material into the desired cap shape. Cap 24 is then welded onto the base plate 10 around a portion of the periphery of the cap, as shown in FIG. 4*c*, such that the cap 24 and the base plate 10 form a casing defining a casing cavity 26 and an opening 28 communicating with the cavity 26. Since the snap element 14 is welded to the base plate 10, which ultimately forms a part of the casing, prior to completion of the casing by welding cap 24 to the base plate 10, attachment of the snap element 14 to the base plate 10 with post 20 is not a blind operation and may be performed with relative ease.

Electrically conductive terminal 30 is then inserted through the terminal opening in the non-conductive mounting 36 to form a terminal assembly. The terminal assembly is then inserted into the cavity 26 through the opening 28, such that the terminal 30 is in contact with the snap contact 22, as seen in FIG. 4*d*. Although this is essentially a blind operation, the positioning boss 12 on the upper surface of the base plate 10 limits the movement of the terminal assembly into the cavity 26 and thereby insures accurate positioning of the terminal assembly. The switch is completed by sealing the opening 28 with an epoxy material, as shown in FIG. 4*e*, thus holding the terminal assembly in its proper place in the cavity 26 and, at the same time, sealing cavity 26 to prevent intrusion of moisture or foreign matter.

Figure 4F:
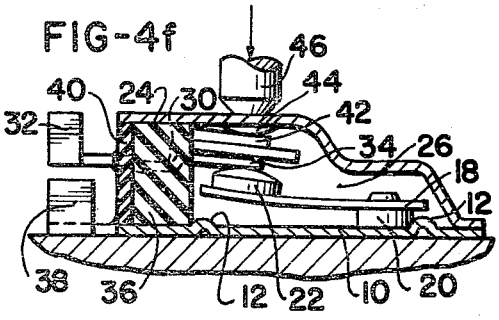

As shown in FIG. 4*f*, an indentation 44 is thereafter formed in the upper portion of conductive cap 24 by pointed tool 46. Indentation 44 is approximately 20 mils in depth. Indentation 44 contacts the terminal backing portion 42 of the mounting 36 such that the terminal contact 34 is urged downward. This ensures that the contact 34 is properly positioned such that the switch will be electrically conductive until the threshold temperature for switch actuation is reached. This technique which may be used to determine the proper depth for indentation 44 is to connect the switch electrically to a monitoring circuit and, thereafter, place the switch in an oil bath which is heated to the threshold temperature for switch actuation. Tool 46 is then pressed against the upper portion of the conductive cap 24 forming the indentation 44 and moving the terminal contact 34 downward until the snap element 14 is snapped and the contacts 22 and 34 opened. This ensures that switch actuation will occur in the desired temperature.

Figure 5A:
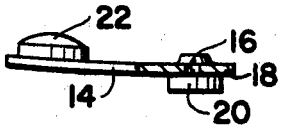

Reference is now made to FIGS. 5*a*–5*f* which illustrate an alternative method of assembly of the thermostatic switch of the present invention. As with the previously described method, the base plate 10 is formed into the desired shape, typically by a stamping operation using a punch press. As shown in FIG. 5*a*, the bimetal snap element 14 is riveted to the top of support post 20 through the rivet receiving opening 16 prior to the welding operation, illustrated in FIG. 5*b*, in which post 20 is welded to the top of base plate 10 such that the base plate 10 is in electrical contact with support post 20. Since the bimetal snap element 14 is in contact with the support post 20 during the welding operation, care must be taken to ensure that the bimetal snap element 14 is not overheated and its thermal snap characteristics adversely affected.

Electrically conductive terminal 30 is then inserted through the terminal opening in the non-conductive mounting 36 to form a terminal assembly. Conductive cap 24 is formed by stamping cold rolled steel material into the desired cap shape, which defines a cap recess 48. As seen in FIG. 5*c*, the terminal assembly is then inserted into the cap recess 48 such that the assembly is properly positioned. If desired, the conductive cap may be deformed slightly that the cap engages the non-conductive mounting 36 and holds the terminal assembly in the recess 48.

Figure 5D:
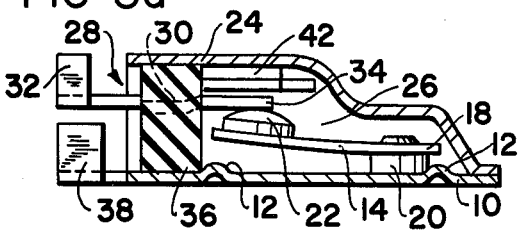
Figure 5B:
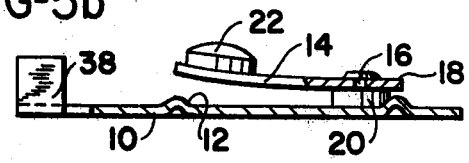

Cap 24, in which is positioned the terminal assembly, is then welded onto the base plate 10 around a portion of the periphery of the cap, as shown in FIG. 5*d*, such that the cap 24 and the base plate 10 form a casing defining a casing cavity 26 and an opening 28 communicating with the cavity 26. Since the snap element 14 and support post 20 are attached to the base plate 10, which ultimately forms a part of the casing, prior to completion of the casing by welding cap 24 to the base plate 10, none of the steps required for assembly of the thermostatic switch are blind operations and, therefore, the switch may be assembled with relative ease.

Figure 5E:
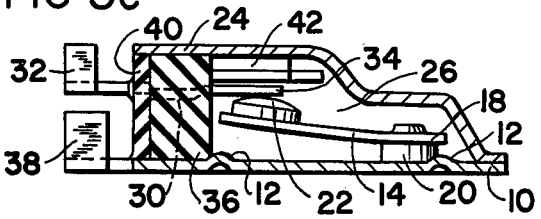
Figure 5C:
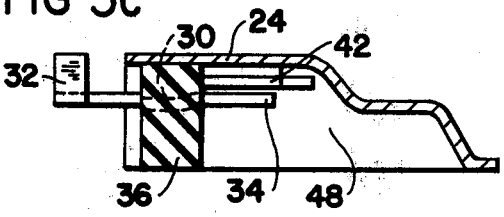

The switch is then completed by sealing the opening 28 with an epoxy material, as shown in FIG. 5*e*, thus holding the terminal assembly in its proper position in the cavity 26 and, at the same time, sealing cavity 26 to prevent intrusion of moisture or contaminant particles.

Figure 5F:
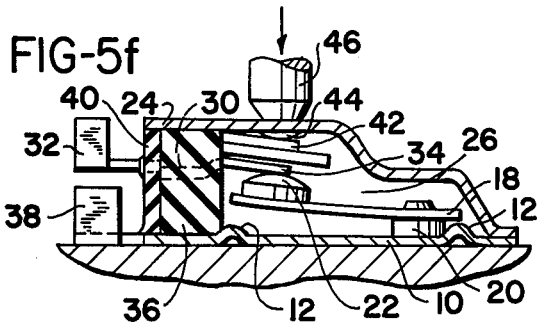

As shown in FIG. 5*f*, an indentation 44 may thereafter be formed in the upper portion of conductive cap 24 by means of pointed tool 46. Indentation 44 is approximately 20 mils in depth and contacts the terminal backing portion 42 of the mounting 36 such that the terminal contact 34 is urged downward and properly positioned for actuation of the switch at the threshold temperature.

While the apparatus herein described and the method of making this apparatus, constitute preferred embodiments of the invention, it is to be understood that the invention is not limited to this precise apparatus and method, and that changes may be made in either without departing from the scope of the invention.

What is claimed is:

1. A thermostatic electrical switch for providing an electrically conductive path when the temperature of the switch is below a threshold temperature and for opening said path when the temperature of the switch is above said threshold temperature, comprising:

a conductive base plate, a bimetal thermostatic snap element which is generally concave upwardly when its temperature is less than said threshold temperature and which snaps to a straightened position when its temperature is above said threshold temperature, said snap element defining a rivet receiving opening in a first end thereof, rivet means, extending through said rivet receiving opening in said snap element and riveted thereto, for mounting said snap element on the top of said base plate and connecting electrically said base plate and said snap element, said rivet means being welded to said base plate, an electrical snap contact mounted on the upper surface of said snap element adjacent a second end of said snap element, opposite said first end, and electrically connected to said snap element, a conductive cap covering said snap element and welded to said base plate around a portion of the periphery of said cap, thereby forming a casing with said base plate, said casing defining a casing cavity in which is positioned said snap element and further defining an opening communicating with said cavity, an electrically conductive terminal having a connector at a first end and a terminal contact at a second end thereof, and mounting means in said opening for mounting said terminal such that said terminal extends through said opening with said terminal contact in contact with said snap contact when the temperature of said snap element is less than said threshold temperature, whereby an electrical path is provided from said casing to said conductive terminal via said snap element and said snap contact until the temperature of said switch exceeds said threshold temperature, at which time said snap element snaps to a straightened position, breaking the conductive path between said terminal contact and said snap contact.

2. The thermostatic switch of claim 1 in which a second electrical connector is provided on said casing and in which said electrically conductive path includes said second electrical connector, said casing, said snap element, said snap contact, and said electrically conductive terminal.

3. The thermostatic switch of claim 2 in which said second connector is provided on said conductive base plate.

4. The thermostatic switch of claim 1 in which said mounting means comprises a non-conductive mounting sized to fit within said cavity in said casing and defining a terminal opening through which said terminal extends, and a layer of epoxy material surrounding said terminal adjacent said opening in said casing and providing a seal thereacross.

5. The thermostatic switch of claim 4 in which said non-conductive mounting includes a terminal backing portion extending parallel to and above said electrically conductive terminal in said casing cavity and in which said conductive cap defines an indentation in the upper portion thereof, said indentation contacting said terminal backing portion such that said electrically conductive material is urged downward by said backing portion whereby said terminal contact is positioned for electrical contact with said snap contact and switch actuation at said threshold temperature.

6. The thermostatic electrical switch of claim 4 further comprising a positioning boss on the upper surface of said base plate abutting said mounting and providing proper positioning of said mounting means and said terminal in said cavity.

7. A method of assembling an electrical thermostatic switch, comprising the steps of:

forming a substantially flat base plate, welding an electrically conductive support post to the top of said base plate, such that said base plate is in electrical contact with said support post, riveting a bimetal snap element to the top of said support post at a first end of said snap element such that said snap element is in electrical contact with said support post, said snap element having a snap contact mounted on the upper surface thereof adjacent a second end of said snap element, forming a conductive cap, welding said cap to said base plate around a portion of the periphery of said cap to form a casing with said base plate, said casing defining a casing cavity in which is positioned said snap element, and further defining an opening communicating with said cavity, inserting an electrically conductive terminal through a terminal opening in a non-conductive mounting to form a terminal assembly, said terminal having a connector at a first end on one side of said mounting and a terminal contact at a second end thereof on the other side of said mounting, said mounting including a terminal backing portion positioned above said terminal contact, inserting said terminal assembly into said cavity through said opening communicating with said cavity such that said terminal assembly is properly positioned, and sealing said opening communicating with said cavity with an epoxy material such that said terminal assembly is held in said cavity.

8. The method of claim 7 further comprising the step of forming an indentation in the upper portion of said conductive cap, which indentation contacts said terminal backing portion of said mounting such that said electrically conductive terminal is urged downward by said backing portion, whereby said terminal contact is positioned for electrical contact with said snap contact and switch actuation at said threshold temperature.

9. A method of assembling an electrical thermostatic switch, comprising the steps of:

forming a substantially flat base plate, riveting a bimetal snap element to the top of a support post at a first end of said snap element such that said snap element is in electrical contact with said support post, said snap element having a snap contact mounted on the upper surface thereof adjacent a second end of said snap element, welding said electrically conductive support post to the top of said base plate, such that said base plate is in electrical contact with said support post, inserting an electrically conductive terminal through a terminal opening in a non-conductive mounting to form a terminal assembly, said terminal having a connector at a first end on one side of said mounting and a terminal contact at a second end thereof on the other side of said mounting, said mounting including a terminal backing portion positioned above said terminal contact, forming a conductive cap including a cap recess, inserting said terminal assembly into said cap recess such that said terminal assembly is properly positioned, welding said cap to said base plate around a portion of the periphery of said cap to form a casing with said base plate, said casing defining a casing cavity in which is positioned said snap element, and further defining an opening communicating with said cavity in which is positioned said terminal assembly, and sealing said opening communicating with said cavity with an epoxy material such that said terminal assembly is held in said cavity.

10. The method of claim 9 further comprising the step of forming an indentation in the upper portion of said conductive cap, which indentation contacts said terminal backing portion of said mounting such that said electrically conductive terminal is urged downward by said backing portion, whereby said terminal contact is positioned for electrical contact with said snap contact and switch actuation at said threshold temperature.

11. The method of claim 9 in which said steps of inserting said terminal assembly into said cap recess includes the step of deforming said conductive cap such that said cap engages said non-conductive mounting, whereby said terminal assembly is held in said cap recess.

* * * * *

UNITED STATES PATENT AND TRADEMARK OFFICE

CERTIFICATE OF CORRECTION

PATENT NO. : 4,220,938

DATED : September 2, 1980

INVENTOR(S) : Jack Wendell Grable

It is certified that error appears in the above-identified patent and that said Letters Patent are hereby corrected as shown below:

Column 1, line 23, "deivce" should be --device--.
Column 8, line 32, "material" should be --terminal--.

Signed and Sealed this

*Thirteenth* Day of *January 1981*

[SEAL]

*Attest:*

SIDNEY A. DIAMOND

*Attesting Officer*

*Commissioner of Patents and Trademarks*